United States Patent [19]

Kelly

[11] 4,365,719

[45] Dec. 28, 1982

[54] RADIOMETRIC ORE SORTING METHOD AND APPARATUS

[76] Inventor: Leonard Kelly, 3 Oakwood Rd., Peterborough, Ontario K9J IN2, Canada

[21] Appl. No.: 280,235

[22] Filed: Jul. 6, 1981

[51] Int. Cl.[3] ..... B07C 5/346

[52] U.S. Cl. ..... 209/589; 209/606; 209/914; 209/639; 209/586; 250/253; 250/255; 250/395

[58] Field of Search ..... 209/576, 589, 606, 914, 209/586, 639; 250/253, 255, 358 R, 395

[56] References Cited

U.S. PATENT DOCUMENTS

| | | | |
|---|---|---|---|
| 2,717,693 | 0/1955 | Holmes | 209/72 |
| 3,011,634 | 12/1961 | Hutter et al. | 209/74 |
| 3,052,353 | 9/1962 | Pritchett | 209/111.5 |
| 3,075,641 | 1/1963 | Hutter et al. | 209/74 |
| 3,216,567 | 11/1965 | Kelly et al. | 209/81 |
| 3,245,530 | 4/1966 | Kelly et al. | 209/81 |
| 4,194,634 | 1/1980 | Kelly | 209/589 |
| 4,231,478 | 11/1980 | Stone | 209/576 |
| 4,320,841 | 3/1982 | Gordon et al. | 209/589 X |

FOREIGN PATENT DOCUMENTS

| | | |
|---|---|---|
| 467482 | of 1950 | Canada . |
| 78/3198 | of 1978 | South Africa . |

*Primary Examiner*—Allen N. Knowles

*Attorney, Agent, or Firm*—Roylance, Abrams, Berdo & Farley

[57] ABSTRACT

A method of and apparatus for sorting pieces or particles of radioactive ore where the particles are moved one after another substantially horizontally then discharged into a gravity-accelerated trajectory which is substantially free-fall but can be controlled to follow a modified path by a low-friction slide plate. The falling particles pass a plurality of radiation detectors arranged in line along their path with increasing velocity due to gravity providing the required separation of the pieces so that each detector is subject to the radiations of essentially only one piece at a time. The size and number of detectors and the path length covered by the detectors is determined by the size of the pieces and the cut-off grade and accuracy required. All counts corresponding to a particular piece and derived successively from the plurality of detectors are accumulated since accuracy increases and percentage of probable error decreases with increased total count. The position and velocity of each piece are determined during their fall to provide close tracking of the particle's path in space and time. If the pieces are sufficiently closely sized the decision to accept or reject a particle may be made on the basis of total accumulated counts being greater or less than a preset figure. If the pieces are not closely sized then the size of each particle is also determined and used in a counts/time/size computation which is compared with set cut-off grade data to provide a decision to accept or reject the particle.

9 Claims, 7 Drawing Figures

RADIOMETRIC ORE SORTING METHOD AND APPARATUS

This invention relates to improved techniques for handling and sorting ore having radioactive properties and for obtaining improved accuracy and reliability in such sorting.

BACKGROUND OF THE INVENTION

While there are many patents related to sorting, relatively few are devoted to the specific peculiarities of sorting radioactive ore. My previous U.S. Pat. No. 4,194,634, Kelly, issued Mar. 25, 1980, reviewed several pertinent patents, namely Canadian Pat. No. 467,482, Lapointe, issued Aug. 22, 1950; U.S. Pat. No. 3,052,353, Pritchett, issued Sept. 4, 1962, and U.S. Pat. No. 2,717,693, Holmes, issued Sept. 13, 1955, and also explained the fundamentals of radiometric sorting as background to that invention. Other documents which are relevant to this topic are U.S. Pat. Nos. 3,011,634, Hutter et al; 3,075,641, Hutter et al; 3,216,567, Kelly et al; and 3,245,530, Kelly et al; and South African published application No. 78/3198, Hawkins et al (Sphere Investments Limited).

It is unnecessary to repeat that review, but it is important to emphasize two basic requirements of radiometric ore sorting: detection time and particle separation. While radioactive ores have the advantage of a built-in characteristic related to grade, i.e., radioactivity, this radioactivity is a random process and fluctuates greatly over a short period, obeying the Poisson Distribution Law. The longer the interval over which the radiation is measured, the greater will be the accuracy. To determine the grade of a piece of given size to a predetermined accuracy using a particular detector configuration requires that the number of counts detected in a given time fall within a given range of values. In addition to this limitation that detection is not instantaneous, but requires finite and appreciable time, radiometric ore sorting has the further problem that the pieces must be separated sufficiently, one from another, so that a detector is exposed to the radiations of only one piece at a time. Note that in configurations which use a plurality of detectors, no purpose is served by using "spaced apart" detectors. The pieces must be spaced apart, not the detectors. The only reason to separate the detectors physically is to allow the introduction of shielding material between, as required, but this by itself would be futile without separation of the particles.

It will be noted herein that the term "particle" is used to describe a rock or lump of ore regardless of size and is not intended to imply a particularly small piece. Thus, the terms "particle" and "rock" can be interpreted, for purposes of the present application, to be interchangeable.

The state of the art prior to the present invention includes two inventions of which I was a co-inventor which are described in U.S. Pat. Nos. 3,011,634 and 3,075,641, previously mentioned. These taught the use of gravity to achieve separation in free-fall past a single radiation detector, in combination with size determination and compensation. The above-mentioned Holmes U.S. Pat. No. 2,717,693 describes the use of multiple detectors in line under a horizontal conveyor belt, and accumulation of the counts from successive detectors. Pritchett U.S. Pat. No. 3,052,353 determines the mass or size of a radioactive ore particle as it moves longitudinally through a scanning head on a conveyor belt, with multiple scintillometers disposed around the belt in the scanning zone. Kelly U.S. Pat. No. 4,194,634 uses asynchronous movement of the particles, controlled by the radiation detected.

Finally, South African published application No. 78/3198 shows a plurality of spaced apart detectors under a conveyor as in the Holmes patent, in combination with a size scanner which may operate over the belt, but is shown in the drawings scanning the particles as they are projected from the end of the belt. The particles are shown spaced apart on the belt, but no mention is made of how they got that way, or that such separation is necessary. On the other hand, great importance is given to the detectors being spaced apart, but no reason is given why this is required.

In addition, there are the following types of radiometric sorters that have actually been manufactured, used and described in various technical papers or advertising brochures:

1. The Lapointe-patent type. Date about 1955. Detector under conveyor belt. No size compensation.
2. Holmes-patent type. About 1955. Multiple detectors under conveyor belt. No size compensation.
3. Hutter et al-patent type. 1958. Free-fall separation past size-scanner and single radiation detector. Size compensation.
4. Cotter Corp., Golden, Colorado, Sorting Plant type. 1975. High grade ore. Uses simple lines of spaced apart particles on conveyor belt with single detectors underneath. Incorporates size scanner and compensation. A paper by J. R. Goode published in "Proceedings of the 7th Annual Meeting of Canadian Mineral Processors" describes such units, and refers to provision of multiple detectors in line for lower grade ores.
5. Hawkins et al-patent application type. 1978–1979. Two almost identical uranium sorters have recently been developed by the only two manufacturers of radiometric sorters in existance, and are currently being sold in competition. These sorters were the result of teams of engineers working on the development which cost into the millions of dollars. The cost of a unit ranges from about one-half million dollars to well over 1 million dollars.

These two commercial sorters have the following features:

A channelized feeder and chute arrangement delivers particles onto a horizontal V-shaped top belt contacted by octagonal idlers which help to vibrate the particles into single lines, nose to tail. The lines of particles travelling horizontally at about 200–300 ft./min. are projected off the end of the belt, and separate as they fall and accelerate due to gravity. When their vertical speed reaches approximately 1000 ft./min. after a 4 to 5 ft. drop, they fall onto a slinger belt similar to the ones used for building mine waste dumps. The concave part of this belt converts the near vertical drop of the pieces to a horizontal movement at about 1000 ft./min., spaced apart, and now going in the reverse direction to the top belt.

The horizontal part of the slinger belt has a section for the rocks to roll around and settle, since they are now 'standing on their head' compared to their stable position on the top belt. They then pass over multiple radiation detectors spaced apart in line under the belt, and fly off the end of the conveyor where they are scanned for size, and then either deflected or not by air blast.

The arrangement is mechanically complex and takes up a great deal of floor space.

SUMMARY OF THE INVENTION

Recalling that two essential features of radiometric sorting are particle separation and maximum time of detection, prior art patents and sorters have shown separately the steps of allowing gravity to achieve separation (Hutter et al), and increasing accuracy by accumulating counts from multiple radiation detectors (Holmes).

The latest commercial sorters, as described above, also use gravity to provide separation, and they also use multiple detectors to accumulate counts, but in between they introduce the awkward step of a high-speed slinger belt which changes the predominantly vertical velocity to horizontal. The slinger also reverses the original horizontal direction and turns each particle over on its 'back'. Many rock pieces seem to have one naturally stable resting position and if this position has been attained on the top belt, the pieces will be unstable during their high-speed run over the detectors on the bottom belt, and also through the size/position scanner.

This slinger step is mechanically complicated and very undesirable from a rock-handling standpoint. The present invention will examine the dynamics of free-fall separation of rock pieces in detail, and show that the slinger step is also unnecessary and can be dispensed with, if other appropriate detection techniques are employed.

Thus, it is an object of the present invention to provide an improved method for sorting radioactive particles by providing the required separation between particles by gravity acceleration, and accumulating counts corresponding to individual particles, derived successively from a plurality of detectors arranged in line along their path of fall.

It is a further object of the invention to provide an apparatus for sorting radioactive particles more efficiently and economically by achieving particle separation and multiple-detector count accumulation while the particles fall in one unbroken gravity-accelerated trajectory.

Accordingly the present invention provides a method for sorting particles of radioactive material which includes the steps of arranging the particles in a single line moving in one direction; successively discharging the particles into a gravity-accelerated trajectory; providing, along the trajectory, means for determining individual particle velocity and means for identifying the time at which each particle occupies a predetermined position in the trajectory, and for producing signals representative of the velocity and time-position determination; providing, along the trajectory, a plurality of radiation detectors arranged so that each detector is consecutively exposed to each particle for producing signals representative of counts of the radiation activity of each particle; accumulating counts from the plurality of detectors for each particle; diverting from the trajectory selected ones of the particles to form two streams of particles, one stream including particles whose accumulated counts exceed a predetermined number and the other stream including the remainder; and separately collecting the particles from the two streams.

Also according to the present invention there is provided apparatus for sorting particles of radioactive material which has a feeder for moving the particles to be sorted substantially horizontally, and arranging them in line, nose to tail, before discharging them in a gravity-accelerated trajectory. The apparatus has means for determining the instantaneous velocity and position of each particle while falling, and means to compute therefrom complete tracking data for the path of each particle. A plurality of radiation detection means, arranged in the line of, and close to the path of the particles, supply counts to accumulator means in synchronism with the passage of a specific particle as determined by the tracking data. A comparison means receives the total accumulated counts from a specific particle as it clears the last detector and compares this with a predetermined cut-off figure. Rejection means responsive to the output of the comparison means either allows the particle to continue its fall, or moves it to a reject trajectory.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION

Figure 1:
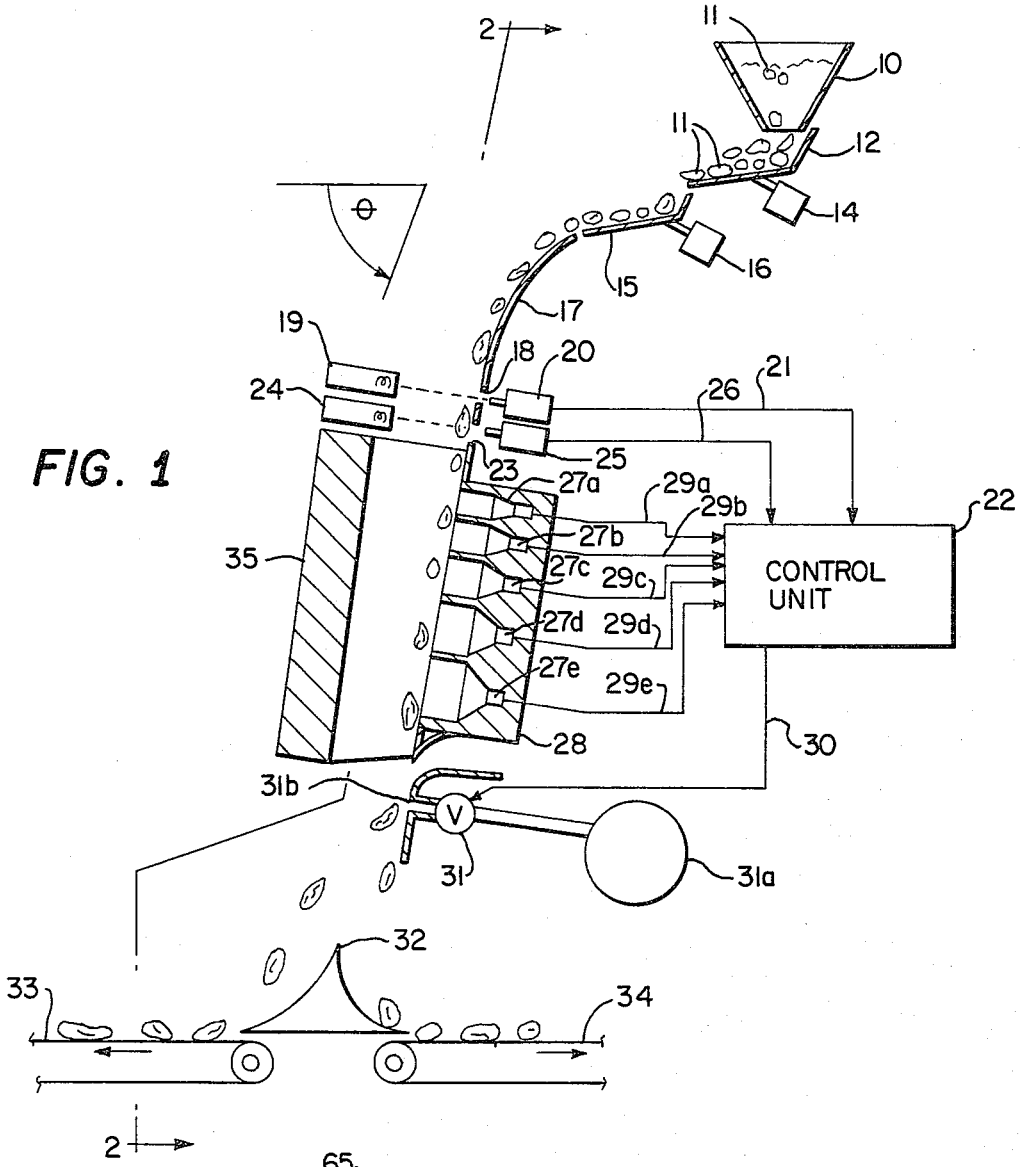
FIG. 1 is a schematic side elevation, partly in section, of an apparatus for sorting ore in accordance with the present invention, taken along line I—I of FIG. 2.
Figure 2:
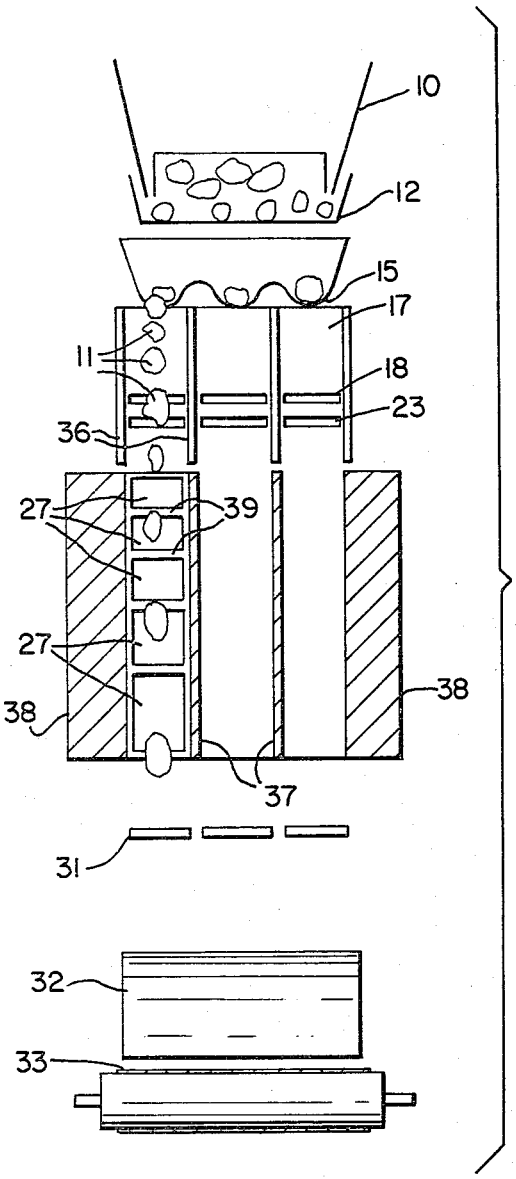
FIG. 2 is a partial front elevation taken along line II—II of FIG. 1.

Referring now to FIGS. 1 and 2, there is shown a side view and a front view of a radiometric sorting apparatus suitable for sorting particles supplied in what can be called a non-uniform feed. As used herein the term "non-uniform feed" is not intended to mean a feed where the particles or pieces of rock can be of widely different sizes. Rather, the term "non-uniform feed" is intended to mean that the particles constituting the feed need not be screened to sizes that are closely similar but may be over a reasonable range because there is a determination of size made by the apparatus. This is distinct from sorting apparatus which requires sufficient screening to provide particles for the feed that are of substantially "uniform" mass such that size need not be determined but wherein this lack will still provide acceptable accuracy.

A bin or hopper 10 holds particles or pieces of ore 11 which are fed out the bottom of the bin onto a table 12 of a vibrating feeder driven by a motor 14. The particles fall from the outlet edge of table 12 onto the table 15 of a second vibrating feeder driven by a motor 16 forming a single-line feed as described in my previous U.S. Pat. No. 4,194,634. The particles 11 leave the edge of table 15, one at a time, travelling at a uniform, controlled speed. As a particle falls it accelerates under gravity along a low-friction fixed slide plate 17 which provides a smooth trajectory isolated from the vibrations of the lip of feeder 15. Each particle 11 passes a window or translucent portion 18 in slide plate 17. A source of light 19 on one side of the slide plate illuminates translucent portion 18, and a photodetector 20 receives light on the opposite side. The passage of a particle 11 past window 18 occults the light received by photodetector 20, and this photodetector 20 provides a signal on conductor 21 representing the passage of a particle, which signal is used as the START signal for particle velocity measurement. Conductor 21 is connected to a control unit 22. A second window or translucent portion 23 is situated at a precisely determined distance below window 18 in slide plate 17 and is illuminated by a light 24. A second photodetector 25 receives light on the opposite side. The passage of a particle 11 past second window 23 occults the light received by photodetector 25 and the photodetector 25 provides a signal on a conductor 26 representing the passage of a particle to control unit 22. Control unit 22 uses the elapsed time between the signals on conductors 21 and 26, which is a measure of the time taken by a particle to travel the known distance between windows 18 and 23, to compute the instantaneous velocity of each particle at window 23 according to well-known projectile trajectory formulae, and its further path, velocity and timing can then be forcast with precision. Photodetector 25 also provides instantaneous particle width information, which, when corrected for acceleration, allows a figure to be derived representing length and area, as will be described in detail later.

The particle 11 continues along slide plate 17 and falls past a series of scintillation counters 27*a–e* which are preferably mounted in a housing 28 made of a radiation shielding material such as lead. The vertical dimensions of the scintillation counters along the direction of the particle path are chosen to be smaller than the smallest gap between particles being sorted, thus ensuring that each radiation detector 27*a–e* sees only one particle at a time. Since the spacing between particles is increasing as they fall, it is more efficient to use radiation detectors which match this spacing in "vertical" dimension. This is shown in FIG. 1, where the vertical dimensions of the lower radiation detectors are greater than the higher ones, i.e., the vertical dimension of each detector is greater than the next higher detector. Separate conductors 20*a–e* transmit counts from the individual detectors to control unit 22.

Control unit 22 uses the tracking data computed for each particle from its measured velocity, (i.e. speed/direction) to anticipate when each particle 11 will be in the appropriate position, passing each detector, for optimum radiation detection. The counts from each individual particle are derived from successive radiation detectors and are stored in separate accumulators.

When a particle passes the last radiation detector, the control unit compares its size and total counts with preset cut-off data and decides whether the piece is ore or waste. If the particle is to be moved to a new trajectory, a control signal on conductor 30 operates an air valve 31 which vents air under pressure from a source tank 31*a* out of a nozzle 31*b* as the particle passes in front of the nozzle. Again, the timing of this signal is computed from the tracking data. The particles fall on one side or the other of a splitter plate 32, those pushed by the air stream from nozzle 31*b* falling beyond the plate onto a conveyor 33. The remaining particles fall short of the splitter plate and are diverted onto a separate conveyor 34.

Further shielding 35 is provided opposite the radiation detector 27 and also at the sides (see FIG. 2).

Although FIG. 1 is a side view showing only a single line, and a single line sorter is indeed possible, it is more efficient and common practice to distribute the feed from a bin into multiple single lines. FIG. 2 is a front view of a sorter with three lines illustrated, and FIG. 1 can be considered a partial section through one of the lines. Apart from the items already described, FIG. 2 shows side guide plates 36 which define channels along the slide plates 17, and join with or merge into lead partitions 37 and side shields 38 in the radiation detection area. The lead partitions 37 cut down radiation from particles in adjoining channels, and side shields 38 together with lead housing 28 and front shield 35, cut down on the reception of noise attributable to background radiations from external sources. FIG. 2 also shows the preferred rectangular shape of the scintillation detectors, each covering the full channel width, but of varying size in the longitudinal or vertical direction. It should be stated however that it would be quite possible to use the old type of cylindrical scintillation counters. They could be placed one or more abreast, to cover the channel width, and they could be of one size only, of a diameter smaller than the minimum particle gap. However, it is advisable to have a section of lead shielding 39 separating scintillation counters longitudinally, to reduce interference from preceeding and suceeding particles, therefore a succession of minimum size scintillation counters would reduce the ratio of scintillation counter area to shielding as "seen" by a particle during its fall. This in turn would reduce count-time and, hence, accuracy. The rectangular, increasing "length", scintillation detectors also have the advantages of requiring little or no compensation for lateral position of the particle, and also have much better geometry for gamma detection when the particle is passing their front surfaces.

There are several variations of the basic sorter as described above. It is well known in sorting to use vibrating feeders and chutes to feed a conveyor belt, forming multiple single lines of nose-to-tail particles, and the present sorter could be used with such an arrangement, the slide plate being designed to suit the designed horizontal speed of the conveyor.

Ideally, the slide plate is of low-friction material, and is shaped so that all pieces slide very lightly down its surface. It should have negligible effect on the trajectory, yet the pieces should pass very close by the radiation detectors. It should also be thin, compatible with reasonable wear, to prevent attenuation of the radiation from the particles. Thin, tempered steel, such as that used for saw blades has been found ideal for being long-wearing, thin, and following the required parabolic curve of the particle trajectory.

As will be shown in detail later in connection with tables of trajectories and separations, the general range of radiation detection should begin after a vertical drop of about 12" to about 18", through a drop of about 84". The exact change of angle to the horizontal, $\theta$, in this range varies with the horizontal projection velocity Vx of the particles as they leave vibrator 15, but at any Vx under consideration, which would be between about 1 and 5 ft./sec., $\theta$ does not change by more than 10°. This means that is quite practical to make the detection section of the slide plate a straight line, tangent to the true trajectory at the top of the radiation detection section. Thus, a system where the true trajectory is a curved trajectory, with $\theta$ starting at $-70°$ and steepening to $-80°$, would thus be adequately approximated by a straight slide at $-70°$. This is mechanically simpler, and ensures close contact between the slide and the rock particles.

A word should be said about the variations in trajectories and velocities. Rock particles have notoriously variable shapes, sizes and length/width/height ratios, so that when they are projected horizontally off a feeder or conveyor at constant speed, they do not have exactly the same trajectories. For example, a chunky particle will behave more like a classical spherical projectile than a long thin piece. The latter projects horizontally until its center of gravity moves beyond the support of feeder or belt. It then tips, and, since its tail end is still supported, develops a rotary motion around its center of gravity. A well-designed, low-friction slide plate will control this motion and keep all pieces in sliding contact. However, since projectile trajectory dynamics must be considered as applying to the center of gravity of the particle, the leading edge of a long piece will pass the velocity detector at a slower velocity than the leading edge of a chunky particle because its center of gravity has not dropped as far at the time the leading edge reaches the velocity detector. The control unit takes this into account in timing the ongoing passage of the particle past scintillation detectors and the air blast. If there were no such velocity variations, a velocity determination would be unnecessary, and a simple trigger and pre-set time delays would be sufficient to gate the scintillation detectors and time the blast valves.

An alternative arrangement which dispenses with precise velocity measurement is to provide a simple light source and photodetector positioned at the start of each radiation detector, to give precise gating of the counts. The control unit would still have to function to allot the counts to the accumulator corresponding to that particle, but this would be a sequencing function, rather than exact timing.

Figure 7:
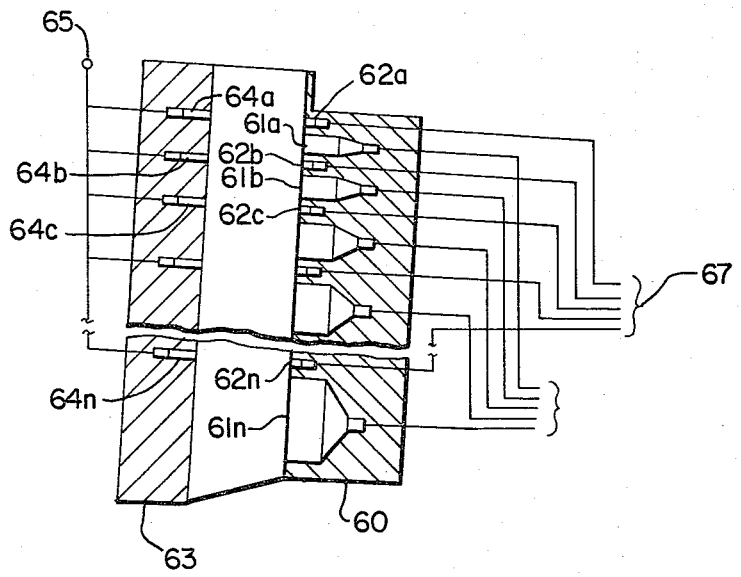
FIG. 7 is a partial side elevation of an alternative or sorting technique.

This arrangement is illustrated in FIG. 7 which shows a shielding housing 60 supporting a sequence of radiation detectors 61*a–n* in a manner similar to FIGS. 1 and 2 with the vertical dimensions of the detectors again increasing as one follows along the trajectory. Adjacent each detector is a photoresponsive device 62*a–n*. On the opposite side of the trajectory path is a shielding wall 63 in or on which are light sources 64*a–n* connected at 65 to a power source, the light sources being aimed at their associated photoresponsive devices. Thus, as each particle falls along the trajectory, it occludes the light from one source to one photoresponsive device which then produces a signal indicating that a particle is about to be exposed to the following radiation detector. The photoresponsive detectors are connected by conductors 67 to the control unit, as are conductors 68 from the radiation detectors so that each occlusion can be used to gate the input from a detector. Thus, velocity determination is no longer needed.

Yet another arrangement would provide the velocity/size/position detectors after the radiation detectors, instead of before. The control unit would perform a back-tracking computation of the flight path, and gather from memory appropriate time segments containing count data from the radiation detectors.

If the particles are sufficiently closely sized, no size compensation is necessary, and a simple comparison of the total accumulated counts from the particle with a preset figure, representing the required cut-off, will enable an ore/waste decision to be made.

It is important now to examine carefully the dynamics of a projectile, and to quantitatively detail the path, separation and timing of a succession of nose to tail particles launched horizontally ($\theta=0$) with uniform velocity Vx. All the relevant formulae are well known to all engineers, and they are given for completeness in the following discussion, but the figures derived from these formulae have unique consequences, and make this present invention feasible. As will be seen, the concept of using multiple detectors along a free-fall trajectory has escaped workers in the radiometric ore sorting field.

Figure 3:
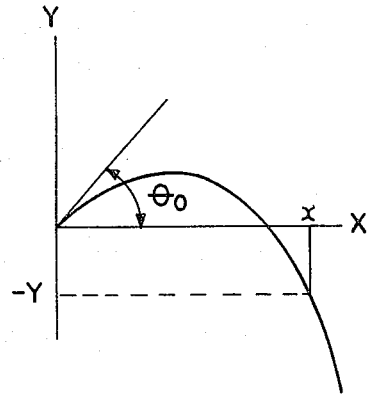
FIG. 3 is a graphical representation of a trajectory illustrating components thereof for explanatory purposes.

Following are the known relationships describing the motion of a body in a gravitational field, neglecting air resistance which is trivial at the velocities and for the shapes involved. In the following, reference is made to FIG. 3, and:

$V_o$=the initial velocity of projection.

$\theta_o$=the angle of projection relative to the horizontal, "up" being positive.

x,y=horizontal and vertical coordinates at any time after projection.

V=velocity.

$V_x, V_y$=horizontal and vertical components of velocity.

As will be recognized, $$x=V_o t \cos\theta$$

$$y=V_o t \sin\theta-\tfrac{1}{2}gt^2=V_{oy}t-\tfrac{1}{2}gt^2$$

$$V_x=V_{ox}=V_o\cos\theta_o$$

$$V_y=V_{oy}-gt=V_o\sin\theta_o-gt$$

Also, $$V=\sqrt{V_x^2+V_y^2}=\sqrt{V_o^2-2gy}$$

$$\theta=\tan^{-1}(V_y/V_x)$$

$$y=(\tan\theta_o)x-[g/2V_o^2\cos^2\theta_o]x^2$$

If $\theta=0$, i.e., horizontal projection, then:

$$x=V_o t$$

$$y=(-gx^2/2V_o^2)=-\tfrac{1}{2}gt^2$$

For a body falling from rest $$V=gt=\sqrt{2gt}$$

$$y=\tfrac{1}{2}gt^2$$

Before looking at particles in a trajectory, let us simplify matters by looking at a particle falling vertically from rest. This corresponds to the accelerating gravity component, $V_y$, which is responsible for the separation of particles in a projectile trajectory. Table 1 lists the time (t, sec.) taken to fall a distance (−Y, in.), and the corresponding velocity ($V_y$,in./sec.). The applicable formulae are $y=V^2.\frac{1}{2g}$ and $y=t^2.g/2$ with g=gravitational acceleration, a constant. In other words, while t and V double, y increases by $2^2=4$.

TABLE 1

| (−Y,in.) | t (sec.) | Vy(in./sec.) |
|---|---|---|
| 0 | 0 | 0 |
| 2 | 0.1017 | 39.3 |
| 4 | 0.1439 | 55.6 |
| 8 | 0.2035 | 78.6 |
| 12 | 0.2492 | 96.3 |
| 16 | 0.2878 | 111.2 |
| 18 | 0.3052 | 117.9 |
| 72 | 0.6105 | 235.9 |
| 84 | 0.6594 | 254.8 |

Since radiometric sorter requirements are for separation and count time, and since separation is a direct function of velocity, and count time is directly related to fall time, it seems on first consideration that this is the reverse of what we want. We are losing a large amount of headroom or height (y), for much smaller increases in separation and count time. However, the important point is that after a drop of 12" from rest the velocity $V_y$ is already 96 in./sec.; at 18" $V_y$ is 118 in./sec., doubling to only 236 in./sec. with a drop of 72". The first thing this means is that if we consider a radiation detection zone from −18" to −72", the velocities are quite within the range of practical rock handling. For example, the two current commercial units described above use a slinger/detector belt speed of 5 meters/sec, or 200 in./sec.. The simple doubling of velocity over 54" presents no great problems in timing and tracking of particles, and the time of detection of about 305 millisec. compares favorably with the current commercial units which use twelve 3" diameter scintillation detectors spaced apart, for a count time of 180 msec. (i.e. 36" of radiation detection, and speed of 200 in./sec.). Count time can be increased if necessary by dropping the particle further past more radiation counters, another 12" to 84" only increasing $V_y$ by 8% and increasing count time by 49 msec. or 16%. Thus detection time and particle velocities and acceleration are quite favorable.

The second point to consider is particle spacing, and here again we can simplify our ideas before listing full trajectory figures. Supposing a succession of 2" diameter uniform particles are being discharged from the end of a conveyor travelling at $V_x$=40 in./sec. (200 ft./min.), then one piece will start to fall each 1/20 sec. or 0.050 sec. Table 2 ignores the horizontal constant velocity $V_x$ of the parabolic trajectory that would arise, and shows simply the vertical fall (−Y, in inches) and the instantaneous vertical velocity ($-V_y$, in./sec.) of a succession of pieces dropped at 50 msec. intervals. The fourth column shows the gap S in inches that would be found between the trailing edge of a particle and the leading edge of a following piece, assuming 2 inch pieces. Thus, for example, the piece center at 48.30 in. has one following at 39.12 in., a center to center distance of 9.18 in., therefore the gap between trailing edge and leading edge is 7.18, as listed.

TABLE 2

| t (sec) | −Vy(in./sec) | −Y(in) | S |
|---|---|---|---|
| 0 | 0 | 0 | |
| 0.05 | 19.3 | 0.48 | |
| 0.10 | 38.6 | 1.93 | |
| 0.15 | 58.0 | 4.35 | |
| 0.20 | 77.3 | 7.73 | |
| 0.25 | 96.6 | 12.08 | 2.35 |
| 0.30 | 115.9 | 17.39 | 3.31 |
| 0.35 | 135.2 | 23.67 | 4.28 |
| 0.40 | 154.6 | 30.91 | 5.24 |
| 0.45 | 173.9 | 39.12 | 6.21 |

TABLE 2-continued

| t (sec) | −Vy(in./sec) | −Y(in) | S |
|---|---|---|---|
| 0.50 | 193.2 | 48.30 | 7.18 |
| 0.55 | 212.5 | 58.44 | 8.14 |
| 0.60 | 231.8 | 69.55 | 9.11 |
| 0.65 | 251.2 | 81.63 | 10.08 |
| 0.70 | 270.5 | 94.67 | 11.04 |

It should be noted that if the radiation detection zone extends from 18" to 72", six pieces are present within that zone having separations (gaps) varying from 4.28 inches to 9.11 inches with velocities ranging from 135 to 232 in./sec. It would be necessary to have at least six detectors to separately assess the pieces in the detection zone. In fact practical considerations of detector size would probably dictate at least 10 detectors to cover the 54". Between detectors it is advisable to have a lead shield of about 2 cm. This thickness stops 99% of 0.3 MEV gammas and 94% of 0.6 MEV gammas. The gamma spectrum of natural uranium ores is predominantly below 0.61 MEV, and furthermore the majority of the radiation from adjoining pieces will slant through the lead shield in a direction not normal to the thickness, but covering a longer path.

These figures are of course all based on perfect projectiles of uniform size, not rocks. Rocks always have a range of sizes, however closely screened. Particles of varying sizes will start into free fall at varying time intervals, and therefore will display varying gaps at any particular drop distance. The smaller the size of a particle, and the greater the horizontal velocity Vx, the smaller will be the gap, requiring a greater number of smaller detectors, or a longer drop to the radiation detection zone.

It should be realized too, that a screen fraction of rock material, e.g. −2"+1", will pass through a 2" screen but not a 1" square mesh screen. Many of the pieces are in fact longer than 2", and only a small percentage will be right on the 1" lower limit. Furthermore, any feeding process designed to produce single lines, as required in radiometric sorting, will inevitably orient the majority of particles with their long dimension in the direction of movement. All this tends to increase the gap between particles above the theoretical minimum. In other words, a sorter feed sized at −2"+1" will have very few successions of 1" pieces, nose to tail.

TABLE 3 lists the full trajectory figures for a succession of 1" pieces being projected horizontally at $V_x=V_o$=36 in./sec. (180 ft./min.). The angle of projection $\theta_o$=0, and $V_{oy}$=0; particles follow each other down the trajectory at 1/36 sec and intervals. The Table shows instantaneous values of $\theta$, x, y, V, $V_y$ (the vertical component of V), and the gap S, to following pieces i.e., space between leading and trailing edges in the radiation zone which is assumed to extend from 18" to 72". The change in $\theta$ is 8° (73° to 81°); the velocity V varies from 123 to 238 in./sec.; $V_y$ is almost the same because of the steep angle, 118 to 236 in./sec.; $V_x$ of course remains constant at 36 in./sec.; the gap opens from 2.1 in. to 5.4 in.; and eleven of the 1" pieces are in the radiation zone.

TABLE 3

| t(sec) | V(in./sec) | −Vy(in./sec.) | −θ° | x(in.) | −y(in.) | S |
|---|---|---|---|---|---|---|
| 0 | 36.00 | 0 | 0 | 0 | 0 | 0 |
| 0.028 | 37.57 | 10.73 | 16.6 | 1 | 0.15 | |

TABLE 3-continued

| t(sec) | V(in./sec) | −Vy(in./sec.) | −θ° | x(in.) | −y(in.) | S |
|---|---|---|---|---|---|---|
| 0.056 | 41.91 | 21.47 | 30.81 | 2 | 0.60 | |
| 0.083 | 48.30 | 32.30 | 40.81 | 3 | 1.34 | |
| 0.111 | 56.03 | 42.93 | 50.02 | 4 | 2.39 | |
| 0.139 | 64.62 | 53.67 | 56.15 | 5 | 3.73 | |
| 0.167 | 73.78 | 64.40 | 60.79 | 6 | 5.37 | |
| 0.194 | 83.31 | 75.13 | 64.40 | 7 | 7.30 | |
| 0.222 | 93.11 | 85.87 | 67.25 | 8 | 9.54 | |
| 0.250 | 103.09 | 96.60 | 69.56 | 9 | 12.08 | |
| 0.278 | 113.21 | 107.33 | 71.46 | 10 | 14.91 | |
| 0.306 | 123.43 | 118.07 | 73.04 | 11 | 18.04 | 2.13 |
| 0.333 | 133.74 | 128.80 | 74.38 | 12 | 21.47 | 2.43 |
| 0.361 | 144.10 | 139.53 | 75.53 | 13 | 25.19 | 2.72 |
| 0.389 | 154.52 | 150.27 | 76.53 | 14 | 29.22 | 3.03 |
| 0.417 | 164.98 | 161.00 | 77.40 | 15 | 33.54 | 3.32 |
| 0.444 | 175.47 | 171.73 | 78.16 | 16 | 38.16 | 3.62 |
| 0.472 | 185.98 | 182.47 | 78.84 | 17 | 43.08 | 3.92 |
| 0.500 | 196.53 | 193.20 | 79.44 | 18 | 48.30 | 4.22 |
| 0.528 | 207.09 | 203.93 | 79.99 | 19 | 53.82 | 4.52 |
| 0.565 | 217.66 | 214.67 | 80.48 | 20 | 59.63 | 4.81 |
| 0.683 | 228.26 | 225.40 | 80.93 | 21 | 65.74 | 5.11 |
| 0.611 | 238.86 | 236.13 | 81.33 | 22 | 72.15 | 5.41 |
| 0.639 | 249.48 | 246.87 | 81.70 | 23 | 78.86 | 5.71 |

The transit time from −18″ to −72″ is about 306 milliseconds. There would be 11 radiation detectors, separated by 10 lead dividers each 2 cm. wide. Thus, the 54″ radiation detection zone would have about 8″ or 15% lead. Counting time would therefore be $306 \times 0.85 = 260$ milliseconds.

The above trajectories have assumed initial projection velocities corresponding to horizontal movement only obtainable by using the vibrating feeders/chute/-belt arrangement. Such an arrangement is mechanically complex, and it takes a considerable amount of floor space for a conveyor belt to align and stabilize the particles nose to tail at high speed. The arrangement shown in FIGS. 1 and 2, using only vibrating feeders projecting straight onto a trajectory plate, is the ultimate in simplicity, and uses the minimum of floor space, but horizontal velocity is limited on current feeders to about 12 in./sec., with correspondingly reduced tonnage rate per line. However, it may be preferable in some circumstances to use several compact, simple units, or provide increased width and number of lines on a single non-belt unit, rather than employing conveyor belts which are susceptible to damage, wear and tracking problems. TABLE 4 lists, for comparison, a trajectory for 1 in. pieces, nose to tail, projected from a feeder moving particles horizontally at 12 in./sec.. Note the steep drop, which only varies from 84° to 87° in the assumed radiation detection zone from y = −18 in. to y = −72 in., which has four pieces in transit, well separated.

TABLE 4

| t(sec) | V(in/sec) | −Vy(in/sec) | −θ° | x(in) | −y(in) | S |
|---|---|---|---|---|---|---|
| 0 | 12.00 | 0 | 0 | 0 | 0 | 0 |
| 0.083 | 34.36 | 32.20 | 69.56 | 1 | 1.34 | |
| 0.167 | 65.51 | 64.40 | 79.44 | 2 | 5.37 | |
| 0.250 | 97.34 | 96.60 | 82.92 | 3 | 12.08 | |
| 0.333 | 129.36 | 128.80 | 84.68 | 4 | 21.47 | 8.39 |
| 0.417 | 161.45 | 161.00 | 85.74 | 5 | 33.54 | 11.08 |
| 0.500 | 193.57 | 193.20 | 86.45 | 6 | 48.30 | 13.76 |
| 0.583 | 225.72 | 225.40 | 86.95 | 7 | 65.74 | 16.44 |
| 0.667 | 257.88 | 257.60 | 87.33 | 8 | 85.87 | 19.13 |

The above Tables of figures demonstrate the following important points, which make the use of multiple detectors in free-fall a new and superior method of radiometric sorting:

1. Particles separate sufficiently within a short vertical drop, to allow radiation detection without interference from succeeding particles.

2. Thereafter, velocity increases only slowly through a long detection zone of several feet, and stays well within current limits of rock-handling, and rock-ejection timing accuracy.

3. Count time is long, and compares favorably with the count time of the current multiple scintillation detector sorters using slinger and conveyor belt arrangements. These factors, separation, count-time, ease of rock-handling, simplicity and compact size, are very advantageous in radiometric sorting.

Figure 4:
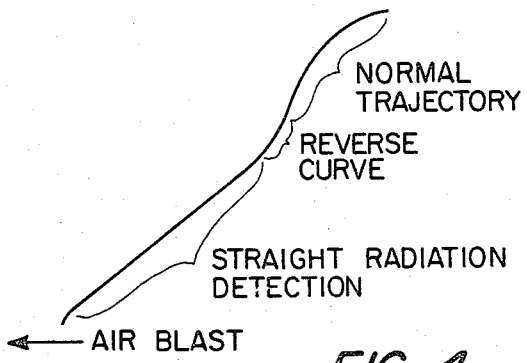
FIG. 4 is a graphical representation of an alternative form of trajectory in accordance with the invention.

As with most new methods, variations are possible. For example, as schematically illustrated in FIG. 4, after an initial section of normal trajectory to achieve the required separation, it is possible to incorporate a section with a reverse curve in the slide plate, which then continues into a straight radiation detection zone at a flattened angle $-\theta°$, calculated to reduce the acceleration to a fraction ($g \sin \theta$) of its normal g value. See FIG. 3. This can significantly increase the count time at the cost of increased wear, and the necessity of tracking the particles by multiple position detectors, rather than prediction from a single velocity determination. This is so, because varying kinetic friction coefficients of varying rock types cannot be predicted accurately. If this were not so, and they had a constant coefficient $\mu K$, a slope $\theta = \tan^{-1} \mu K$ would produce a constant velocity down the slide, and hence constant separation and maximum count time for a given slide path length.

Figure 5:
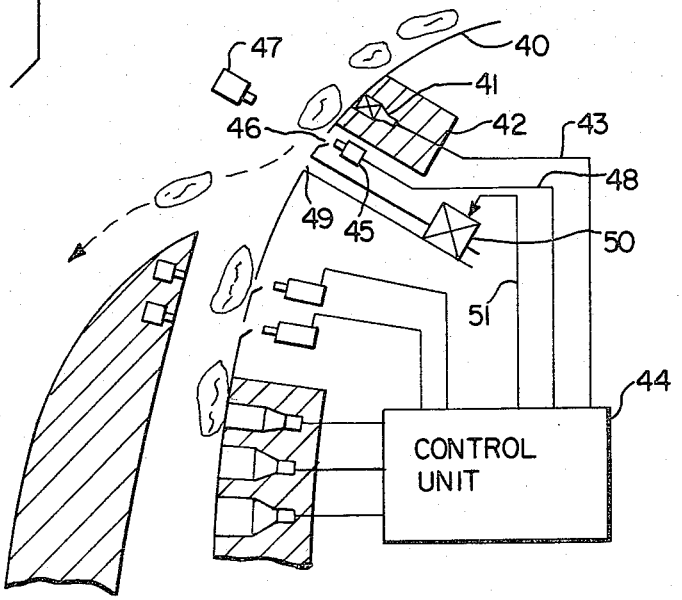
FIG. 5 is a schematic side elevation of a further embodiment of the invention.

One other variation is useful with certain uranium ores which contain very high grade pieces along with the normal grade material. Some recently discovered deposits, for example, have pieces running 20% $U_3O_8$, while much of the remaining material is around 0.2% $U_3O_8$. FIG. 5 shows an embodiment of the sorter which removes the high-grade pieces at a first stage in the trajectory, and then allows normal material to continue through for ordinary sorting as previously described.

Referring to FIG. 5, slide plate 40 follows the normal discharge trajectory. A small radiation detector 41, well shielded by lead housing 42 is located as shown, and conductor 43 carries a signal representing counts to control unit 44. Immediately following the housing 42 a photodetector 45 is aimed through window 46 at a light source 47, and transmits a signal representing a rock passage to control unit 44 on conductor 48. Air blast nozzle 49 is connected to air valve 50, which is controlled by control unit 44 by means of a signal on conductor 51. Thereafter the unit is similar to FIG. 1.

In operation, scintillation detector 41 operates into a short time-constant ratemeter in the control unit. If the rate of counts exceeds a predetermined high level, a latch is set, and the next particle "seen" by photodetector 45 operates air valve 50, and ejects the high grade particle. Passage of the trailing edge of the particle resets the latch.

It should be noted that no size is taken into account, and none is required. This section is for rejecting only very high grade pieces which are so radioactive that they would affect many particles in the stream if allowed to pass through the normal part of the sorter, and size is immaterial. It should also be noted that this high grade discharge function is difficult, if not impossible, to accomplish on a conveyor belt type sorter.

Control unit 22 in FIGS. 1 and 5 is shown as a generalized "black box" with certain functions. These functions may be implemented electronically in a variety of ways, and refined and elaborated with great sophistication. However such details are a matter of electronic design and do not affect the essence of the invention. The following description has as its basis a modern micro-computer which uses various components with well defined functions organized around and interconnected by a common bus. This bus may contain, for example, 100 lines for transferring Data, Address, I/O and Interrupt signals. Only a general description of the program required will be given as detailed programming depends on the particular micro-computer used.

Figure 6:
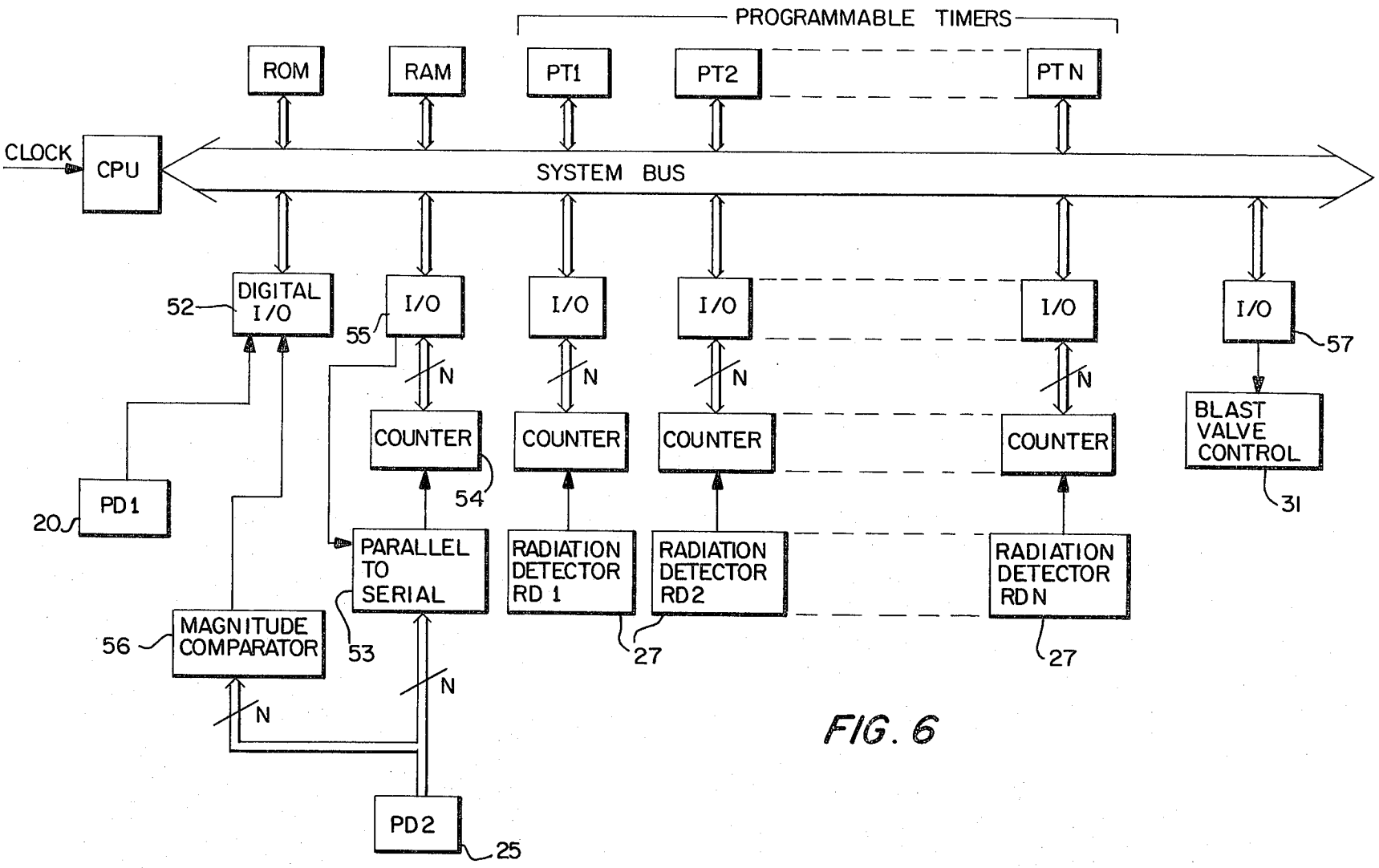
FIG. 6 is a schematic functional block diagram illustrating a signal handling and processing system usable in the present invention.

FIG. 6 shows the organization of the computer in diagrammatic form. It includes components commonly found in a dedicated control computer, namely Clock, CPU, Read Only Memory (ROM), Random Access Memory (RAM), Digital Input/Output Ports, and Programmable Timers. Inputs are as shown in FIG. 1, and include photodetectors (PD1,PD2), and radiation detectors (RD1, RD2 . . . RDN). The output is to the blast valve control 31.

Photodetector (PD1) 20 has a single ON/OFF output, corresponding to the passage of a particle, and its input is delivered through I/O 52. Photodetector (PD2) 25 has two functions, first as an ON/OFF detector, to time the leading Edge (LE), and Trailing Edge (TE) of a passing particle, and secondly as a width detector giving an output proportional to the instantaneous width of a particle as seen through window 23. The latter can be accomplished in several well known ways, such as analog occulting with A-D conversion, self-scanned arrays, or an array of discrete photodiodes. The latter is a simple method and is used in FIG. 6. Photodetector (PD2) 25 consists of an array of discrete photodiodes spaced along the width of window 23. Each photodiode forms one input to parallel-to-serial converter 53 which is connected to counter 54. The output of counter 54 is the input, as shown, to I/O 55. The parallel-to-serial conversion takes place under program control, and the output of counter 54 is the number of photodiodes occulted, applied to I/O 55. The ON/OFF function of PD2 may be accomplished by means of magnitude comparator 56 which is preset to give an output of I/O 52 when any single photodiode is occulted.

Pulses from the separate radiation detectors are inputs to individual counters under program control, and read out to their respective I/O Ports, again under program control, as will be described. Finally, an I/O Port 57 signals blast valve control 31.

There are 7 distinct phases in the movement of a particle through the sorter:

1. LE past PD1
2. LE past PD2
3. Transit past PD2
4. TE past PD2
5. Timing past scints (radiation detectors)
6. Ore Waste decision point
7. Blast timing.

1. The Leading Edge (LE) of a particle past PD1 initiates an Interrupt which causes the program to start Programmable Timer (PT1). PT1 will measure the time for the LE to travel the fixed distance between PD1 and PD2.

The LE past PD1 also serve to increment a particle-address counter. This counter has a greater capacity than the number of particles which could be in the sorting system, i.e., 16, so it progresses 0,1,2, . . . 15,0,1, . . . Thus, each new particle is assigned a number (i) which is used to address a separate program timer (PTi), area accumulator (AAi) and count accumulator (CAi) corresponding to spaces in RAM reserved for that particular particle number. The PT is used to time out area and radiation detector count times, decision time and blast timing, corresponding to measured velocity and length of the particle. The AA stores a binary number corresponding to area, and derived from PD2. The CA stores a binary number representing the accumulated counts from all scints corresponding to that particular particle.

2. The LE past PD2 is sensed by magnitude comparator 56 when one of the photodiodes is occulted, and initiates an Interrupt which stops PT1. The elapsed time to travel the known distance between PD1 and PD2 is converted to Vi, the instantaneous velocity at PD2, by referencing a table residing in ROM, and Vi, the velocity of the particular particle i, is then stored in a section of RAM reserved for all data connected with particle i (Pi).

PT1 is immediately reset and restarted once the LE, PD1 to PD2 time has been transferred, and starts to time LE to TE past PD2.

PTi, the programmable timer assigned to this particle, is started at this time (LE past PD2) as this is counted as Time Zero for Pi, in calculating all timed activities related to this particle.

3. As the particle progresses past PD2, consisting of an array of photodiodes, as described, incremental widths are accumulated to derive a binary number corresponding to area. Since the particle is accelerating, if the widths are taken at equal time intervals, the area will be in error, since the velocity increases by about 15% over 5". It is preferrable, now that Vi is known, to have PTi access another table held in ROM and corresponding to Vi, which will strobe the parallel to serial converter 53 and read counter 54 at successively shorter time intervals corresponding to equal length intervals. These area counts are accumulated in area accumulator AAi, located in the Pi area of RAM.

4. The trailing edge (TE) of Pi past PD2 is signalled by magnitude comparator 56 when no photodiodes are occulted. This causes an Interrupt which stops PT1, and the time it has measured (LE to TE past PD2) is transferred to the Pi area of RAM. PT1 is now available for the next particle after reset.

The velocity of the particle at PD2 and the time for LE to TE to pass PD2 are now available, and together uniquely determine the sequence of times that the LE and TE will take to travel past any other specified points on the trajectory, such as scints, decision point and blast valve. It is convenient to have a series of tables in ROM, precalculated to cover the range of velocities and range of lengths which will be encountered. Both ranges are limited, and therefore for practical increments the number of tables is not large and the number of separate times within each table is small: an on- time and off-time for each scint, a decision time, and a blast on-time and off-time.

5. As a particle LE approaches a scint, there is a rapid build-up of the count rate until the TE comes within range. Thereafter, there is a much smaller increase until the particle is centered. There is an optimum position of the particle to gate the scint counters on and off, and the times corresponding to the LE switch-on and TE switch-off for each scint counter are accessed from the appropriate table and timed out by PTi. The counts are transferred to the appropriate count accumulator, CAi located in the Pi section of RAM, as each particle passes a scint, and then the counter is reset, to await the next particle.

6. As the last scint in line is passed, and its associated counter contents have been added to the count accumulator, the total counts and previously accumulated area counts are together compared with pre-set cut-off data. The decision to blast or not blast the particle is made at this time.

7. The final timing data contained in the table and accessed by PTi, is blast timing, and this allows for the mechanical delay to open and close the valve.

It should be noted that this system allows the handling of the required number of particles through the sorter simultaneously. Certain parts are reserved for specific particles, but such items as look-up tables could be used by any number of particles.

While certain advantageous embodiments have been chosen to illustrate the invention it will be understood by those skilled in the art that various changes and modifications can be made therein without departing from the scope of the invention as defined in the appended claims.

What is claimed is:

1. A method for sorting particles of radioactive material which includes the steps of arranging the particles in a single line moving in one direction;

successively discharging the particles into a gravity-accelerated trajectory;

providing, along the trajectory, means for determining individual particle velocity and means for identifying the time at which each particle occupies a predetermined position in the trajectory, and for producing signals representative of the velocity and time-position determination;

providing, along the trajectory, a plurality of radiation detectors arranged so that each detector is consecutively exposed to each particle for producing signals representative of counts of the radiation activity of each particle;

accumulating counts from the plurality of detectors for each particle;

diverting from the trajectory selected ones of the particles to form two streams of particles, one stream including particles whose accumulated counts exceed a predetermined number and the other including the remainder; and separately collecting the particles from the two streams.

2. A method according to claim 1 wherein the radiation detectors are provided with successively increasing exposure dimensions in the direction of the trajectory so that the times of exposure of the particles to each detector are substantially equal despite increasing particle velocity.

3. A method according to claim 2 and including vertically positioning first radiation detector along the trajectory such that the separation between particles due to gravity acceleration is greater than the exposure dimension of the first detector as measured along the trajectory.

4. A method for sorting particles of radioactive material which includes the steps of arranging the particles in a single line moving in one direction;

successively discharging the particles into a gravity-accelerated trajectory;

providing, along the trajectory, a plurality of radiation detectors arranged so that each detector is consecutively exposed to each particle for producing signals representative of counts of the radiation activity of each particle;

providing adjacent each detector means for determining the time at which each particle occupies a predetermined position relative to its associated detector, and for producing signals representative of the time-position determination;

accumulating counts from the plurality of detectors for each particle;

diverting from the trajectory selected ones of the particles to form two streams of particles, one stream including particles whose accumulated counts exceed a predetermined number and the other including the remainder; and separately collecting the particles from the two streams.

5. An apparatus for sorting particles of ore in accordance with their radioactivity characteristics comprising feeder means for arranging the particles in line, for moving the line of particles in one direction toward a discharge end and for successively discharging the particles into a gravity-accelerated trajectory;

means for determining the presence and velocity of each particle in the trajectory at a known position in the trajectory and for producing signals representative of the motion thereof along the trajectory path;

a plurality of radiation detection means arranged along and close to the trajectory path for receiving radiation from the particles, one at a time, and for producing count signals representative of the level of radiation activity of each particle;

means for receiving said signals representative of motion and said count signals and for separately accumulating the count signals from all of said radiation detection means attributable to each particle and for producing distinctively different output signals depending upon whether the accumulated count for a particle is above or below a predetermined value;

means for selectively altering the trajectory of particles which have passed said radiation detection means in response to one of said output signals from said means for receiving; and means for separately collecting the particles from the altered and unaltered trajectories.

6. An apparatus according to claim 5 wherein said radiation detection means includes a series of scintillation counters each having an active radiation-receiving surface adjacent said trajectory, the surface of each said counter after the uppermost counter being longer in the direction along the trajectory than the preceding counter.

7. An apparatus according to claim 6 and further comprising radiation shielding means between said counters for isolating radiation to which they are exposed.

8. An apparatus according to claim 7 wherein the vertical separation between the discharge end of said feeder means and the uppermost one of said counters, and the dimension of said uppermost counter in the direction of said trajectory are selected such that said dimension is less than the separation between particles as a result of acceleration through said vertical separation.

9. An apparatus according to claim 5 wherein said means for determining presence and velocity includes first and second photodetectors spaced apart along said trajectory so that each particle sequentially passes said photodetectors, whereby said detectors produce signals spaced apart in time representing a unique velocity determination for each particle.

* * * * *